United States Patent [19]

Iannelli

[11] Patent Number: 4,476,690

[45] Date of Patent: Oct. 16, 1984

[54] DUAL TEMPERATURE REFRIGERATION SYSTEM

[76] Inventor: Frank M. Iannelli, 5215 Pogue St., Spartanburg, S.C. 29301

[21] Appl. No.: 403,142

[22] Filed: Jul. 29, 1982

[51] Int. Cl.[3] ..... F25B 49/00

[52] U.S. Cl. ..... 62/198; 62/395; 62/59

[58] Field of Search ..... 62/198, 59, 393, 394, 62/395

[56] References Cited

U.S. PATENT DOCUMENTS

| | | | |
|---|---|---|---|
| 2,198,328 | 4/1940 | Brown et al. | 62/198 |
| 2,235,244 | 3/1941 | Ames et al. | 62/393 X |
| 2,454,537 | 11/1948 | Atchison | 62/198 |
| 2,531,315 | 11/1950 | Wyllie, Jr. | 62/393 X |
| 2,586,499 | 2/1952 | Anderson | 62/394 X |
| 2,687,020 | 8/1954 | Staebler et al. | 62/198 |
| 2,706,894 | 4/1955 | Shoemaker | 62/198 X |
| 2,791,099 | 5/1957 | Jordan | 62/198 |
| 2,861,433 | 11/1958 | Booth | 62/394 X |
| 4,011,733 | 3/1977 | Kuckens et al. | 62/59 |

*Primary Examiner*—William E. Tapolcai
*Attorney, Agent, or Firm*—Julian W. Dority

[57] ABSTRACT

A dual temperature refrigeration system which includes a first and second evaporator coil which chills water and freezes water within a tank for producing carbonated water. A restrictor tube is connected between the first evaporator coil and the second evaporator coil for reducing the temperature of the refrigerant flowing through the second evaporator coil. When the demand occurs for chilled water, a switch provided in a by-pass conduit extending around the second evaporator coil is opened, permitting the refrigerant to by-pass the second coil which is used for producing an ice bank in the carbonator.

2 Claims, 2 Drawing Figures

DUAL TEMPERATURE REFRIGERATION SYSTEM

BACKGROUND OF THE INVENTION

Heretofore, normally when producing carbonated water, chilled water from an exterior source was fed into the carbonator so that carbon dioxide could be bubbled therethrough for producing the carbonated water. Normally, a separate cooling system was utilized for producing this chilled water. It is desirable when making carbonated water that the water being fed to the carbonating tank be approximately 34° F. since the cooler the water, the better the carbonation. Normally, compressor systems utilized in cooling water have carbonating systems which only bring the water down to 34° F. because of the tolerance of the controls. If the controls of the condensor were set to a temperature of approximately 32° F., often, the water would freeze because of the tolerance of the control. This, of course, would prevent carbonated water from being produced.

Furthermore, usually a separate refrigeration system would be utilized for dispensing cold water.

Attempts have been made to develop systems that produce different temperatures within a single system, for example, for cooling water and for producing ice. Examples of such devices are disclosed in U.S. Pat. Nos. 3,783,630; 2,156,668; 2,605,621; 2,653,014; 3,739,842 and 2,322,627. Other patents developed during a search include U.S. Pat. Nos.2,396,460; 2,554,638 and 4,036,621.

SUMMARY OF THE INVENTION

The device constructed in accordance with the present invention provides a means of producing a dual temperature refrigeration unit with a single refrigeration system.

In one particular embodiment, the system is capable of producing cool or cold water for being dispensed through a spicket and also cooling water to a lower temperature for maximizing carbonation in a carbonating tank. Of course, it is to be understood that there are many different applications for the dual temperature refrigeration system and the carbonating tank is merely one example of a use for such a system. In the carbonator tank system, a stainless steel tank is provided and has a diffuser therein through which carbon dioxide is fed for bubbling through water contained in the tank. In order to maximize the carbonation of the water in the tank, it is important that the temperature of the water in the tank be maintained at approximately 32° F. to 32.5° F. This is accomplished by building up a layer of ice on the inner wall of the tank. A temperature sensing probe is positioned closely adjacent the layer of ice for controlling the flow of refrigerant through an evaporator coil extending around the outer periphery of the tank. It is to be understood, of course, that the evaporator coil could be positioned along the inner wall of the tank if desired. The probe positioned in the tank controls the thickness of the ice buildup within the tank.

In order to increase the efficiency of the carbonating system, it is desired that the water entering the carbonating tank be chilled to a temperature of approximately 34° F. before entering the tank. This is accomplished by a second cold water evaporator coil that is positioned concentric to the inner freezing evaporator coil and separated therefrom by a layer of insulation.

The water that is to be chilled is fed through another coil that is in surface contact with the evaporator cold water coil so that as the water is fed through the cold water coil, it is chilled to approximately 34–35° F. A second temperature sensor is positioned adjacent the outer surface of the cold water coil for selectively turning on the condenser for feeding refrigerant through the evaporator cold water coil to ensure the desired temperature of cold water.

Accordingly, it is an important object of the present invention to provide a dual temperature refrigeration unit for freezing and chilling liquids.

Another important object of the present invention is to provide a simple and efficient device for producing liquids of two different temperatures.

Another important object of the present invention is to provide a single refrigeration system for producing fluids or liquids of two different temperatures.

BRIEF DESCRIPTION OF THE DRAWINGS

The construction designed to carry out the invention will be hereinafter described together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
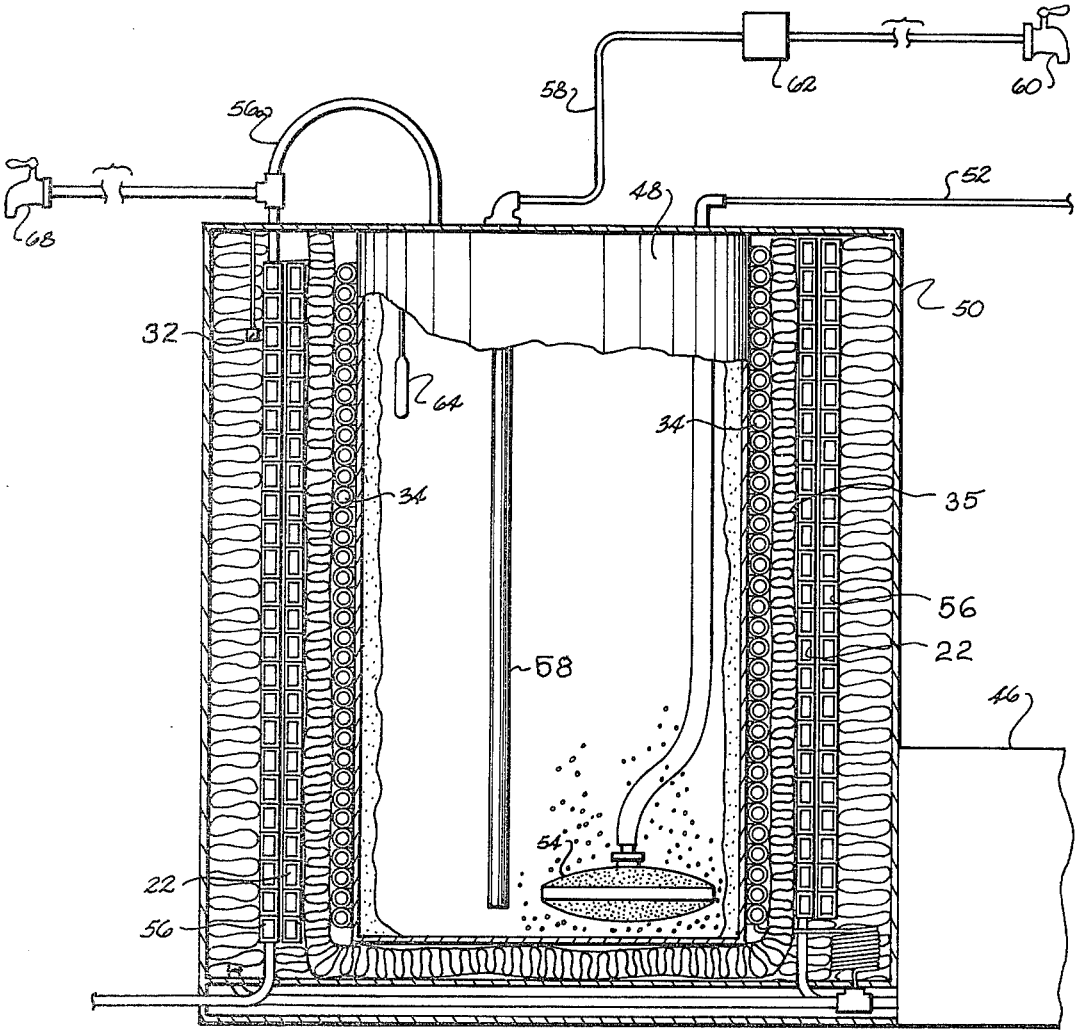
FIG. 1 is an elevational view partially in section illustrating a refrigeration system constructed in accordance with the present invention.

Referring in more detail to the drawings, there is illustrated a dual temperature refrigeration unit constructed in accordance with the present invention which includes a compresser unit generally designated by the reference character 10 constructed in any conventional manner. The compressor unit 10 includes a compresser 12, a fan 14, and a condenser 16. The output of the condenser is fed through a liquid line drier 18 to a wound capillary tube 20. As the liquid reaches the capillary tube 20, it goes through an evaporator cold water coil 22. This lowers the temperature of the gas flowing through the coil and, as a result, the temperature of the coil is approximately 34° for cooling water. The output of the cold water coil 22 is connected to a T-joint 24. One leg of the T is connected through a small bore restrictor 26 and the other leg of the T is connected to a by-pass conduit 28 which has a solenoid valve 30 interposed therein. This is a normally closed solenoid valve which is selectively opened and closed by a thermostat 32 which will be more fully described below.

The other end of the small bore restrictor tube 26 is connected to an end of another evaporator coil 34 which is provided for lowering the temperature of the surrounding medium even further than the temperature drop obtained by the cold water evaporator coil 22. The other end of the evaporator coil 34 is connected to one leg of a T 36. The other leg of the T 36 is connected by means of a tube 38 to the output side of the solenoid valve 30. The third leg of the T 36 is connected by a return conduit 40 to a suction line accumulator. A suction line accumulator 42 ensures that all liquid coming through tube 40 is maintained in the suction line accumulator allowing only gas vapor to be fed back to the compressor. It is to be understood, of course, that you do not want liquid to be fed back to the compressor.

Referring now, in particular, to FIG. 1 of the drawing, the compressor unit 10 is carried in the housing 46 positioned alongside the carbonating and beverage dispensing device. A carbonating tank 48 is centrally located within a housing 50 and has a line connected to the top thereof for receiving carbon dioxide. The line 52 transports the carbon dioxide to the bottom of the carbonator tank through a diffuser 54 for being bubbled through water carried within the tank 48. Water entering the tank 48 is by means of copper tube 56*a*. The carbonated water that is produced in the tank is removed from the tank through a conduit 58 which extends to the bottom of the tank. A dispensing valve 60 is provided for dispensing the carbonated water from the tank through a syrup mixing valve 62 for producing a carbonated drink. The particular valve mechanism for controlling the flow of water to and from the tank automatically is not disclosed since such is a conventional item. One particular valving mechanism that could be used is disclosed in U.S. Pat. No. 3,637,197 issued to James L. Hudson on Jan. 25, 1972.

The evaporator coil 34 extends around the outside wall of the tank 48 and as the refrigerant passes therethrough, it causes a layer of ice to be formed on the inner wall of the tank which extends radially inwardly approximately one inch. A thermostat 64 is positioned closely adjacent the layer of ice on the inner wall of the carbonator for controlling the operation of the compressor unit 10 for maintaining the thickness of the ice at approximately one inch.

Figure 2:
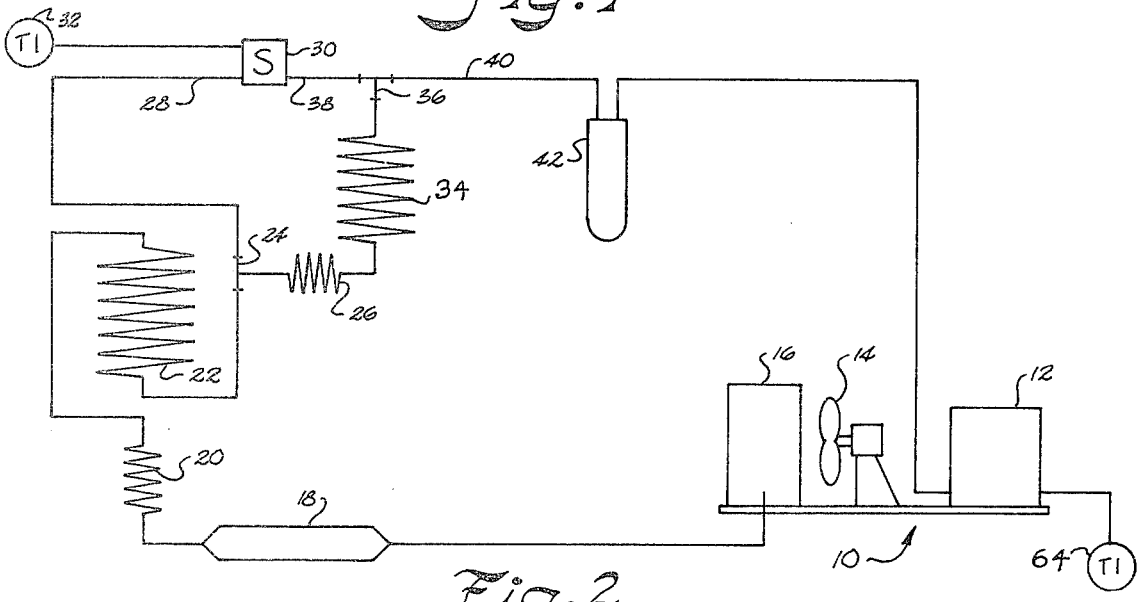
FIG. 2 is a schematic diagram showing the various coils utilized in the system.

The main evaporator coil 22 is concentrically wound around the evaporator coil 34 and is spaced therefrom by means of a layer of insulation 35. This evaporator coil is constructed of relatively flat tubing so as to increase the efficiency of heat exchange between its surface and the surface of another flat coil 56 through which water flows for being pre-cooled prior to being fed into the carbonator tank through tube 56*a* or dispensed through an exterior dispensing valve 68. A thermostat 32 is positioned alongside the water coil 56 for selectively opening and closing the solenoid valve shown in the circuit of FIG. 2. It is noted that water from any suitable source is fed to the system through a line coming out of the bottom of the carbonator.

In operation, another thermostat 64 carried within the tank indicates that the water provided in the tank is above 32° to 32.5° F. due to the melting of the ice bank therein causing the compressor unit to be turned on. When the compresser unit 10 is turned on, liquid Freon is fed through the capillary tube 20 and exits therefrom in the main evaporator coil 22. This causes the water carried in the coil 56 to be chilled to approximately 34° F. It is noted that during this time, the solenoid valve 30 is opened and the evaporator coil 34 is more or less by-passed because of restrictor tube 26. Upon the water in the tube 56 reaching its desired temperature of approximately 34° F., the thermostat 32 de-energizes the solenoid valve 30 closing the solenoid valve 30. When the solenoid valve 30 is closed, the Freon exiting from the cold water evaporator coil 22 passes through a small bore restrictor 26 to the evaporator coil 34 carried on the inner wall of the tank 48 for lowering the temperature of the water in the tank so as to build up the ice layer in the tank 48 to its desired thickness of approximately one inch. Upon the temperature of the water carried within the tank 48 reaching approximately 32° F., the thermostat positioned within the tank cuts off the compressor unit indicating that all units are satisfied, that is, there is sufficient ice buildup on the inner wall of the tank and water carried within the coil 56 is approximately 34° F. As the water is utilized causing the temperature of the water in the coil 56 to rise above a predetermined level, the thermostat 32 turns on the compressor unit and energizes solenoid valve 30 opening the conduit 28 so that the main flow of refrigerant by-passes the refrigeration coil 34 and only flows through the evaporator coil 22 for cooling the water.

As a result of the thermostat 32 operating both the solenoid valve 30 and the compresser unit 10, the water flowing through tube 56 is maintained at approximately 34° F. and the condition of maintaining it at this temperature must first be satisfied before the refrigerant can be fed through the evaporator coil 34 for building up the ice layer within the tank.

While the dual temperature refrigeration system has been described above in connection with a carbonator it is to be understood that it could be used in other situations where dual temperature is needed such as for chilling beer in a cooler at one temperature and dispensing it at another temperature.

In one particular embodiment, the restrictor tube 26 is 18" long and has an inside diameter of 0.064 inches. The restrictor tube is seven feet long and has an inside diameter of 0.05 inches. The evaporator coil 22 is made of ⅜ inch tubing and is approximately twenty feet long.

While a preferred embodiment of the invention has been described using specific terms, such description is for illustrative purposes only, and it is to be understood that changes and variations may be made without departing from the spirit or scope of the following claims.

What is claimed is:

1. A dual temperature refrigeration system comprising:

a compressor unit supplying a flow of refrigerant;

a first evaporator coil having an input end connected to said compressor for receiving refrigerant therefrom;

a capillary tube connected between said compressor and said first evaporator coil for causing said refrigerant flowing through said first evaporator coil to reduce the temperature of said first evaporator coil and the surrounding medium to a first predetermined temperature;

a return conduit extending to said compressor unit;

a restrictor tube having one end connected to the output end of said first evaporator coil;

a second evaporator coil connected between the other end of said restrictor tube and said return conduit;

a by-pass conduit extending between said output end of said first evaporator coil and said return conduit;

switch means provided in said by-pass conduit for selectively opening and closing said by-pass conduit for directing the main flow of refrigerant from said first evaporator coil either through said by-pass conduit or said restrictor tube and said second evaporator coil;

said restrictor tube causing said refrigerant flowing through said second evaporator coil to reduce the temperature of said second evaporator coil and the surrounding medium to a second predetermined temperature lower than said first temperature;

a carbonation tank having water therein;

said second evaporator coil being coiled around said tank for producing an ice bank in said tank when refrigerant is permitted to flow through said second evaporator coil;

a liquid dispensing coil carried in heat transfer relation with said first evaporator coil having one end connected to a source of water and the other end terminating in said carbonation tank so that water flowing through said liquid dispensing coil is chilled by said first evaporator coil prior to said water entering said carbonation tank wherein the temperature of said chilled water is reduced even further for enhancing carbonation;

a first thermostat carried adjacent said liquid dispensing coil for energizing and opening said switch means when said temperature of said liquid coil rises above a predetermined level; and a second thermostat carried in said water in said tank for energizing said compressor unit when said water rises above a predetermined temperature.

2. The dual temperature refrigeration system as set forth in claim 1 further comprising:

a source of carbon dioxide;

a diffuser means carried in the bottom of said tank;

means for supplying said carbon dioxide from said diffuser means for bubbling said carbon dioxide through said chilled water carried in said tank producing carbonated water.

* * * * *